US006471367B2

(12) United States Patent
Garofalo

(10) Patent No.: US 6,471,367 B2
(45) Date of Patent: Oct. 29, 2002

(54) TORCH FOR SCUBA DIVING

(75) Inventor: Giovanni Garofalo, Rapallo (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 09/737,468

(22) Filed: Dec. 18, 2000

(65) Prior Publication Data

US 2001/0006460 A1 Jul. 5, 2001

(30) Foreign Application Priority Data

Jan. 5, 2000 (IT) ..... GE2000A02

(51) Int. Cl.[7] ..... F21V 33/00

(52) U.S. Cl. ..... 362/190; 362/109; 362/158; 362/208; 362/183; 362/577

(58) Field of Search ..... 362/25, 190, 559, 362/577, 109, 158, 253, 184, 208, 183, 295; 315/200 A, 169.3; 340/321; 250/483.1; 248/271

(56) References Cited

U.S. PATENT DOCUMENTS 4,876,632 A * 10/1989 Osterhout et al. ..... 362/183
5,578,992 A * 11/1996 Harding ..... 340/574
5,839,821 A * 11/1998 LeZotte ..... 362/253
6,394,622 B1 * 5/2002 Macek ..... 362/228

FOREIGN PATENT DOCUMENTS

| | | |
|---|---|---|
| DE | 43 16 691 | 11/1994 |
| GB | 2276713 | 10/1994 |

* cited by examiner

*Primary Examiner*—Sandra O'Shea
*Assistant Examiner*—Anabel Ton
(74) *Attorney, Agent, or Firm*—Larson & Taylor, PLC

(57) ABSTRACT

Torch for scuba diving comprising a body housing the batteries, a lamp and its electric circuitry, and a handle extending from said body. A box housing a display is mounted on the torch handle, which display is connected to a microcomputer coupled to the electric system of the torch and displaying both the torch duration in minutes and the indication of the lighting intensity selected by the user. A push-button turns on and regulates the lighting power of the torch. The box is pivoted on the end of the torch handle, and can be turned over from an operating position to a rest position in which the display is protected from possible shocks. The support pins of the box are preferably coupled to a general switch, so that by turning the box the torch is turned off.

8 Claims, 1 Drawing Sheet

TORCH FOR SCUBA DIVING

BACKGROUND AND SUMMARY OF THE INVENTION

The present invention relates to torches for scuba diving. The torches used at present are equipped with rechargeable batteries al ways with high powers, even in the range of 100 W.

These new-generation torches allow the user both to vary the light power of the torch, so as to suit it to the existing requirements, and to have an idea on the remaining duration of the torch, which, as far as highly sophisticated torches are concerned, can be carried out by means of several leds, so that the turning off of the leds one after the other indicates a decrease in the charge. This is mere theory, but as far as practice is concerned this indication is rather approximate and the user never knows the actual remaining duration of his/her torch.

Moreover, for building reasons said leds are always located on the back side of the cylindrical body of the torches, because this is the best portion where the led can be installed. However, when the user keeps the torch in his/her hand, he/she cannot see directly that portion and must turn the torch in order to see the bottom of said torch, which is not always easy to do.

The present invention aims at avoiding said and other disadvantages of the torches available at present.

According to a main feature of the invention, a display connected to a microcomputer is mounted onto the torch handle, said display being coupled to the electric system of the torch and displaying a whole series of information. For instance, it displays the present duration in minutes, and said display is constantly updated even in relation to the change in light intensity made by the user.

According to a further feature of the invention, a push-button for the regulation of light power is provided on the torch handle, and the set regulation appears on the display. Therefore, the user can always check on the torch display both the remaining duration of his/her torch and the light power set by means of said push button, as well as additional information, such as the indication that the torch batteries are under charge, etc.

According to another feature of the torch according to the invention, the display box, instead of being fixed onto the torch handle, is preferably supported on the end of said handle by means of two pins equipped with a snap regulation with an elastic coupling allowing its rotation of 180° around one of its end cross axis, or alternatively said box can be supported by means of a middle pin, so that it can be turned of 180° around its longitudinal axis, said pin or pins being coupled to the electric system of the torch, so that when the display is turned from a position which will be defined as active to a passive or rest position, the electric circuit between the torch batteries and the lamps is opened. Said features shows the following advantages:

(1) when the torch is not used the display is not endangered, since it is folded under the handle or turned towards the torch sheath, so that it is protected against possible shocks;

(2) said operation embodies a safety measure against the unintentional turning on of the torch, since the contact is disconnected and there is no danger that the torch loses its charge unintentionally.

BRIEF DESCRIPTION OF THE DRAWINGS

Other features and advantages of the present invention will be more evident in the following detailed description of a form of embodiment of said invention, shown as mere non-limiting example and carried out with reference to the enclosed drawings, in which.

DESCRIPTION OF THE PREFERRED EMBODIMENT OF THE INVENTION

Figure 1:
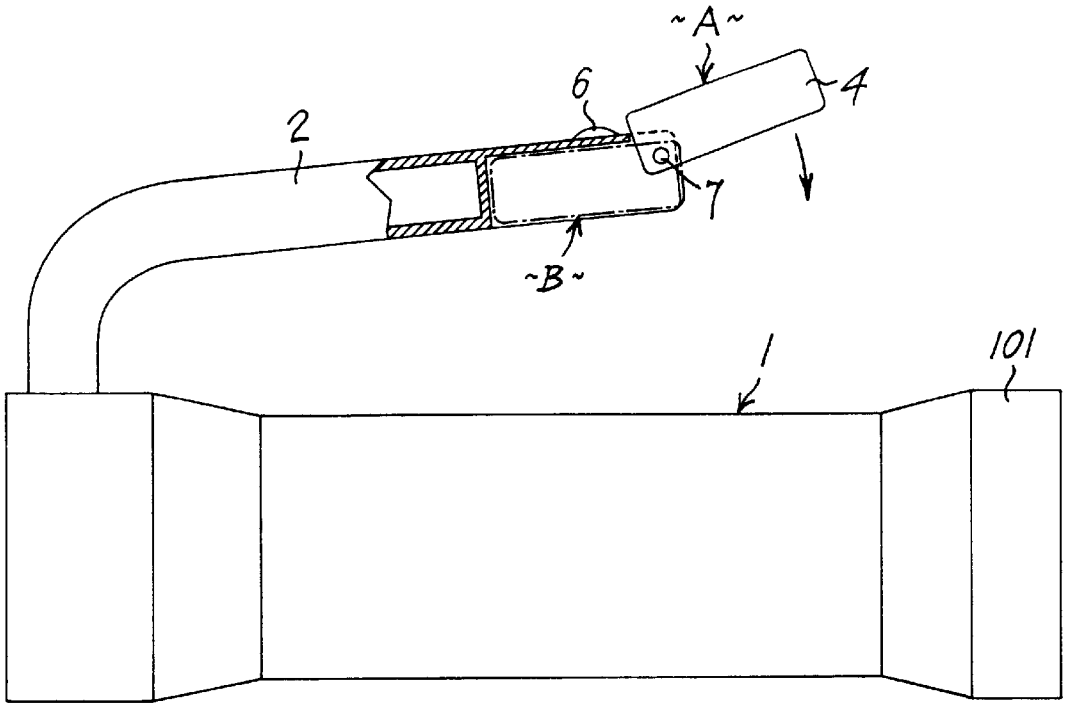
FIG. 1 is a lateral view of a torch according to the invention, with the handgrip partly sectioned.

With reference to the drawings, the torch illustrated therein consist of a substantially cylindrical body 1, which houses the batteries and carries in its front end 101 the lamp or lamps (not shown).

From the back portion of the body 1 a handgrip 2 stretches upwards and then bends parallel to the axis of the body 1 and ends on its free end with a fork-shaped portion 3, among whose two arms 103, 203 the box 4 housing the display 5 and the control microcomputer (not shown) are fixed. A sequential push-button 6 is provided on the end of the handle 2, said push-button being connected to the electric circuit of the torch to the purposes described below. The box 4 is pivoted to the arms 103, 203 by means of pins, which are in their turn coupled to a rotating switch (not shown), whose function is to set in a position (position A in FIG. 1 of box 4) both the electric connection between the computer (and therefore the display) and the batteries and the electric elements of the torch, and to cut off the power supply to the lamps when the box 4 is turned from position A of FIG. 1 to position B of the same figure, in which it is located in a housing provided in the lower portion of the end 3 of the handle 2.

The working of the described device will be obvious.

Figure 2:
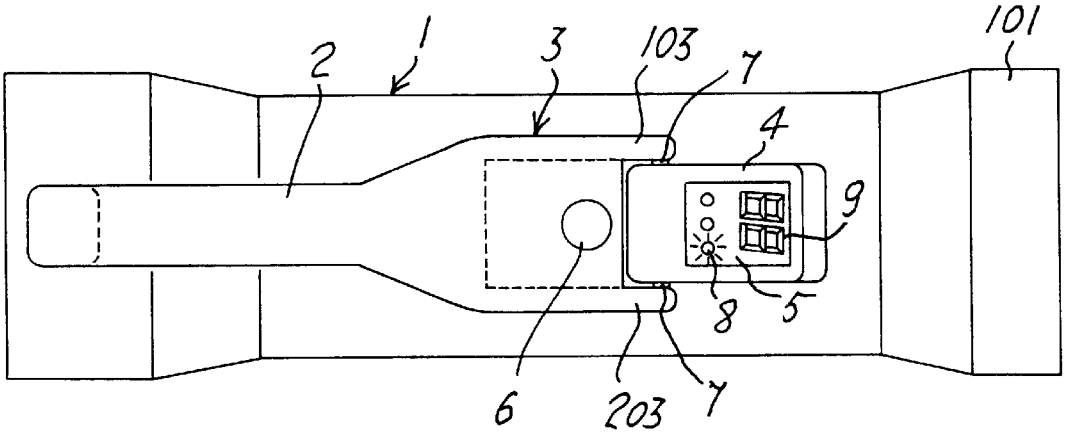
FIG. 2 is a top plan view of the torch in FIG. 1.

The torch is set to work by shifting the display box 4 from the rest position B, indicated by the dashed line in FIG. 1, to position A, indicated by a full line in the same figure. By pushing the button 6 the torch is turned on, and by keeping said button pushed the power goes from minimum to maximum, and vice versa, said changes being shown on the display 5 by means of the lighting of one or more icons (for instance a sun 8, as shown in FIG. 2). Moreover, the display 5 shows the remaining lighting time in minutes (indication 9 of FIG. 2). The display can obviously show other functions, such as the charging of the torch batteries, and so on.

In order to turn off the torch the box 4 should be switched from position A to position B of FIG. 1. As mentioned before, by means of said operation it is possible both to protect the display 5 from shocks and to prevent the unintentional turning on of the torch during transport, since the switch connected to the pins of the box 4 also works as a general switch by insulating the sequential switch 6.

The present invention is obviously not limited only to the form of embodiment here illustrated and described. So, for instance, the box 4, instead of being connected to the handle 2 by means of two pins arranged on a transversal axis, can be connected to said handle by means of a single pin, which is co-axial to the central middle axis of the box 4, said pin being in its turn coupled to the general switch of the torch, so that, by turning the box 4 of 180° around its middle axis, the torch is turned off and the display is thus positioned in a protected position, that is to say, turned towards the body 1 of the torch.

According to another embodiment of the invention, the box 4 can be connected to the handle 2 without any possibility of movement. In such a case, in order to prevent the unintentional operation of the button 6 when the torch is put away, shielding means can be provided for said push-button, such as a sliding shutter element which can be shifted over the bush-button 6 when the torch is not used, so as to prevent an unwanted operation of said push-button.

Therefore, the present invention is not limited to the forms of embodiment here illustrated and described, but it relates to all those changes and embodiments within the ampler idea underlying the invention, substantially as claimed below.

I claim:

1. A torch for scuba diving, comprising:

a body housing batteries, a lamp, electric circuitry connecting the batteries and the lamp and a handle extending from said body, a box mounted on said torch handle and housing a display, power selecting means for the user to select the intensity of the lighting, said display being connected to a microcomputer coupled to the electric system of the torch and displaying both the time duration of the charge and an indication of the lighting intensity selected by the user, and a push button mounted on the handle for turning the torch on and off.

2. A torch according to claim 1, in which the power selecting means includes said push button which is sequential and is operable to regulate the lighting power of the torch.

3. A torch according to claim 1, wherein the box is pivoted on the torch handle and can be turned about its pivot connection between an operating position and a rest position.

4. A torch according to claim 1, in which said box is connected to the end of said handle by means of two transverse co-axial pins, said handle being provided on its lower side with a housing in which said box is housed when it is shifted to its non-operating position.

5. A torch according to claim 3, in which said box is pivoted on said handle by means of a central axial pin, which is co-axial with respect to the longitudinal middle axis of the said box, said box being turned alternately around said pin from an operating position in which the display is turned upwards, to a position turned 180° with respect to the previous position, in which the display is turned towards the torch sheath.

6. A torch according to claim 3, in which the support pin or pins of said box are coupled to a general switch, so that the turning of said box from said operating position to said non-operating rest position causes the turning off of the torch.

7. A torch according to claim 1, including shielding means for said push-button, in order to prevent the unintentional operation of said push-button.

8. A torch according to claim 7, in which said shielding means comprises a sliding shutter element which can be shifted over said push-button.

* * * * *